US009957763B2

(12) United States Patent
Greening et al.

(10) Patent No.: US 9,957,763 B2
(45) Date of Patent: May 1, 2018

(54) FLOW CONTROLLED BALL RELEASE TOOL

(71) Applicant: Halliburton Energy Services, Inc., Houston, TX (US)

(72) Inventors: Aimee Kathleen Greening, Duncan, OK (US); Brian Keith Ogle, Duncan, OK (US); Tina Denise Hawkins, Marlow, OK (US); Pedro Alfredo Sors, Ciudad del Carmen (MX); Carlos Daniel Wild, Villahermosa (MX)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 226 days.

(21) Appl. No.: 14/777,351

(22) PCT Filed: Dec. 1, 2014

(86) PCT No.: PCT/US2014/067924

§ 371 (c)(1),
(2) Date: Sep. 15, 2015

(87) PCT Pub. No.: WO2016/089352

PCT Pub. Date: Jun. 9, 2016

(65) Prior Publication Data

US 2016/0298406 A1 Oct. 13, 2016

(51) Int. Cl.
*E21B 23/04* (2006.01)
*E21B 34/14* (2006.01)
(Continued)

(52) U.S. Cl.
CPC ..... *E21B 23/04* (2013.01); *E21B 17/20* (2013.01); *E21B 33/12* (2013.01); *E21B 34/14* (2013.01);
(Continued)

(58) Field of Classification Search
CPC ..... E21B 23/04; E21B 33/12; E21B 34/14; E21B 2034/007; E21B 43/14; E21B 43/26
See application file for complete search history.

(56) References Cited

U.S. PATENT DOCUMENTS 2,117,536 A * 5/1938 Baker ..... E21B 21/10 166/193
5,511,618 A * 4/1996 Budde ..... E21B 21/10 166/321
(Continued)

FOREIGN PATENT DOCUMENTS

PL 161083 B1 5/1993

OTHER PUBLICATIONS

International Search Report and Written Opinion for PCT/US2014/067924 dated Jul. 30, 2015.

*Primary Examiner* — Frederick L Lagman
(74) *Attorney, Agent, or Firm* — McDermott Will & Emery LLP

(57) ABSTRACT

A ball release tool includes a body providing a first end and a second end, and defining a flow passageway extending between the first and second ends. A ball is releasably coupled to the body at the second end. One or more flow ports are defined in the body and in fluid communication with the flow passageway, wherein pressure of a fluid introduced into the flow passageway is increased to release the ball from the body.

23 Claims, 2 Drawing Sheets

(51) Int. Cl.

| | |
|---|---|
| ***E21B 43/26*** | (2006.01) |
| ***E21B 43/14*** | (2006.01) |
| ***E21B 17/20*** | (2006.01) |
| ***E21B 33/12*** | (2006.01) |
| ***E21B 41/00*** | (2006.01) |
| *E21B 47/00* | (2012.01) |
| *E21B 34/00* | (2006.01) |

(52) U.S. Cl.
CPC ..... *E21B 41/0078* (2013.01); *E21B 43/14* (2013.01); *E21B 43/26* (2013.01); *E21B 47/00* (2013.01); *E21B 2034/007* (2013.01)

(56) References Cited

U.S. PATENT DOCUMENTS 5,680,902 A * 10/1997 Giroux ..... E21B 21/10 166/321
5,836,395 A * 11/1998 Budde ..... E21B 21/106 166/321
7,143,831 B2 * 12/2006 Budde ..... E21B 34/14 166/192
7,640,991 B2 1/2010 Leising
9,200,499 B2 * 12/2015 Hall ..... E21B 33/16
2001/0045288 A1 * 11/2001 Allamon ..... E21B 21/10 166/373
2004/0231836 A1 11/2004 Budde
2006/0243455 A1 11/2006 Telfer et al.
2010/0126715 A1 * 5/2010 Dithmar ..... E21B 23/04 166/194
2010/0212885 A1 8/2010 Hall et al.
2010/0212886 A1 * 8/2010 Hall ..... E21B 23/04 166/194
2010/0263876 A1 10/2010 Frazier
2012/0285687 A1 11/2012 Turner et al.
2013/0168099 A1 * 7/2013 Themig ..... E21B 34/103 166/308.1
2013/0248194 A1 9/2013 Huang
2013/0333890 A1 12/2013 Dagenais et al.
2015/0107829 A1 * 4/2015 Themig ..... E21B 34/14 166/255.1
2015/0159469 A1 * 6/2015 Purkis ..... E21B 23/04 166/373

* cited by examiner

FLOW CONTROLLED BALL RELEASE TOOL

BACKGROUND

In the oil and gas industry, subterranean formations penetrated by a wellbore are often hydraulically fractured to enhance hydrocarbon production. Hydraulic fracturing operations are typically carried out by strategically isolating various zones of interest (or intervals within a zone of interest) in the wellbore using packers and the like, and then subjecting the isolated zones to a variety of treatment fluids at increased pressures.

Today, it is possible to stimulate multiple zones during a single stimulation operation by using onsite stimulation fluid pumping equipment. In such applications, several packers are introduced into the wellbore and each packer is strategically deployed at predetermined intervals that isolate adjacent zones of interest. Each zone may have a sliding sleeve movably disposed within a casing that lines the wellbore. Each sliding sleeve may be movable between a closed position, where the sliding sleeve occludes one or more flow ports defined in the casing at that location, and an open position, where the flow ports are exposed and fluid communication is allowed between the casing and the surrounding formation.

The sliding sleeves may be selectively shifted to the open position using, for instance, a ball drop system, which sequentially drops wellbore projectiles from a surface location into the wellbore. The wellbore projectiles, commonly referred to as "frac balls," are of predetermined sizes configured to seal against correspondingly sized baffles or seats associated with each sliding sleeve. Smaller frac balls are introduced into the wellbore prior to the larger frac balls, where the smallest frac ball is designed to land on the baffle furthest from the wellhead, and the largest frac ball is designed to land on the baffle closest to the wellhead. Applying hydraulic pressure from the surface serves to shift the target sliding sleeve to its open position.

Some wellbores have extended horizontal portions and a tight surrounding subterranean formation can make it difficult to achieve the necessary flow rates to carry wellbore projectiles to target baffles to actuate the sliding sleeve.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates generally to wellbore operations and, more particularly, to ball release tools that hydraulically operate to release a ball to land on and actuate a sliding sleeve assembly.

Embodiments of the present disclosure provide ball release tools that are capable of carrying a ball through a horizontal section of a wellbore and releasing the ball in front of a target baffle. The ball release tools may include a body having a first end, a second end, and a flow passageway extending between the first and second ends. The ball may be releasably coupled to the body at the second end, and one or more flow ports may be defined in the body and in fluid communication with the flow passageway. The flow ports may be used to circulate a flow of a fluid through the ball release tool at a relatively low pressure while running the ball release tool downhole. Once the ball release tool is located at the desired depth, the flow rate of the fluid may be increased, which may cause an increased backpressure that releases the ball from the body. The ball may then locate the target baffle and increasing the fluid pressure against the ball may then serve to shift a sliding sleeve associated with the target baffle from a closed position to an open position.

Figure 1:
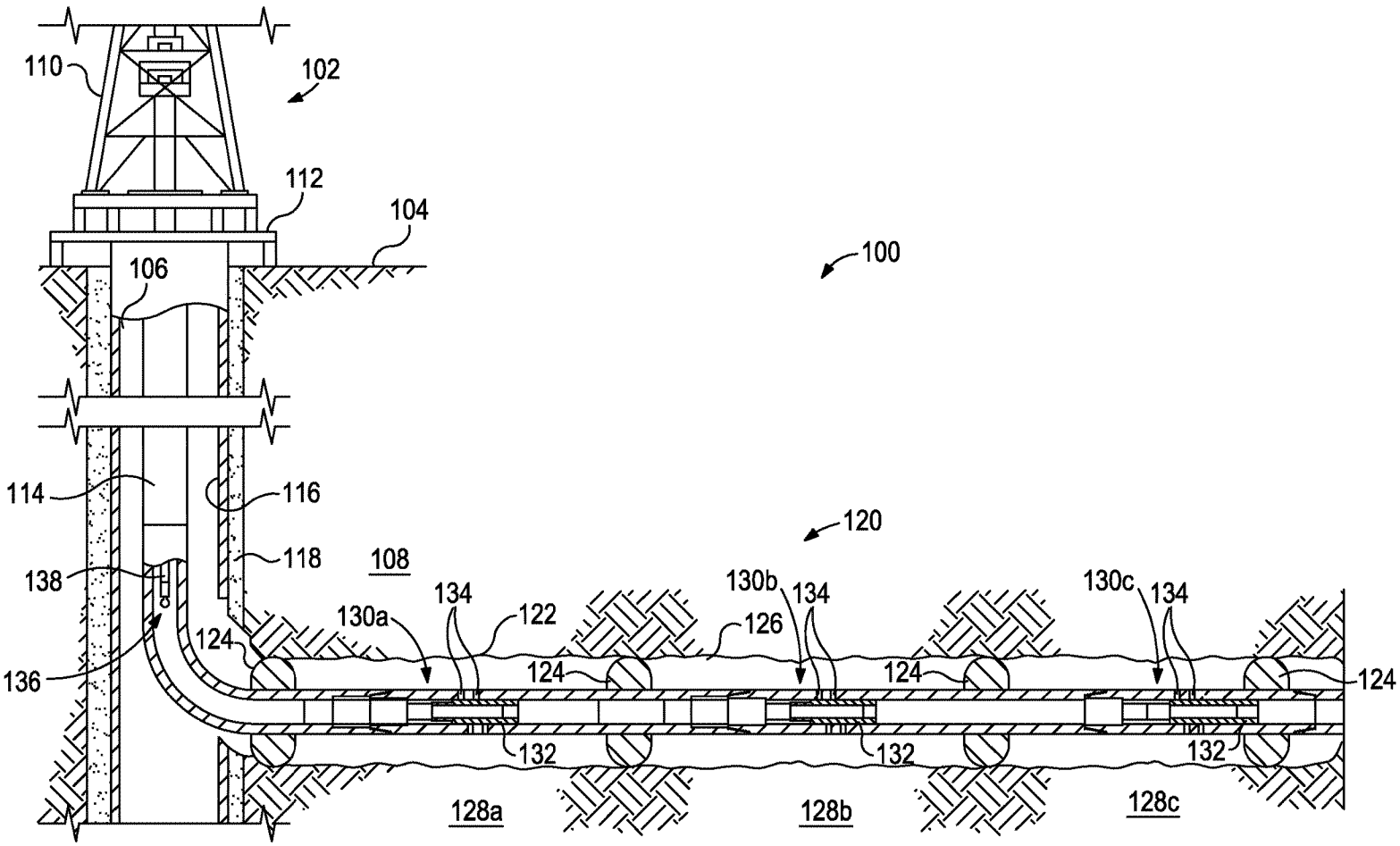
FIG. 1 is an illustration showing a well system that employs the principles of the present disclosure.

Referring to FIG. 1, illustrated is an exemplary well system 100 that can employ the principles of the present disclosure, according to one or more embodiments. As illustrated, the well system 100 may include an oil and gas rig 102 arranged at the Earth's surface 104 and a wellbore 106 extending therefrom and penetrating a subterranean earth formation 108. Even though FIG. 1 depicts a land-based oil and gas rig 102, it will be appreciated that the embodiments of the present disclosure are equally well suited for use in other types of rigs, such as offshore platforms or rigs used in any other geographical location. In other embodiments, the rig 102 may be replaced with a wellhead installation, without departing from the scope of the disclosure.

The rig 102 may include a derrick 110 and a rig floor 112. The derrick 110 may support or otherwise help manipulate the axial position of a work string 114 extended within the wellbore 106 from the rig floor 112. As used herein, the term "work string" refers to one or more types of connected lengths of tubulars or pipe such as drill pipe, drill string, casing, landing string, production tubing, coiled tubing combinations thereof, or the like. The work string 114 may be utilized in drilling, stimulating, completing, or otherwise servicing the wellbore 106, or various combinations thereof.

As illustrated, the wellbore 106 may extend vertically away from the surface 104 over a vertical wellbore portion. In other embodiments, the wellbore 106 may otherwise deviate at any angle from the surface 104 over a deviated or horizontal wellbore portion. In other applications, portions or substantially all of the wellbore 106 may be vertical, deviated, horizontal, and/or curved. In some embodiments, as illustrated, the wellbore 106 may be at least partially cased with a string of casing 116. The casing 116 may be secured within the wellbore 106 using, for example, cement 118. In other embodiments, the casing 116 may be omitted from the well system 100.

In some embodiments, a completion assembly 120 may be coupled to the work string 114 and otherwise form an integral part thereof, and the work string 114 may extend into a branch or horizontal portion 122 of the wellbore 106. As illustrated, the horizontal portion 122 may be an uncased or "open hole" section of the wellbore 106. In other embodiments, however, the completion assembly 120 may form an extension of the casing 116 to line the horizontal portion 122, without departing from the scope of the disclosure. In such embodiments, the work string 114 might comprise the casing 116 or another type of completion tubing.

In some embodiments, the completion assembly 120 may be arranged or otherwise deployed within the horizontal portion 122 of the wellbore 106 using one or more packers 124 or other wellbore isolation devices known to those skilled in the art. The packers 124 may be configured to seal off an annulus 126 defined between the completion assembly 120 and the inner wall of the wellbore 106. As a result, the subterranean formation 108 may be effectively divided into multiple intervals or "pay zones" 128 (shown as intervals 128*a*, 128*b*, and 128*c*) which may be stimulated and/or produced independently via isolated portions of the annulus 126 defined between adjacent pairs of packers 124. While only three intervals 128*a-c* are shown in FIG. 1, those skilled in the art will readily recognize that any number of intervals 128*a-c* may be defined or otherwise used in the well system 100, including a single interval, without departing from the scope of the disclosure.

The completion assembly 120 may include one or more sliding sleeve assemblies 130 (shown as sliding sleeve assemblies 130*a*, 130*b*, and 130*c*) arranged in, coupled to, and otherwise forming integral parts of the work string 114. As illustrated, at least one sliding sleeve assembly 130*a-c* may be arranged in each interval 128*a-c*, but more than one sliding sleeve assembly 130*a-c* may alternatively be arranged within each interval 128*a-c*, without departing from the scope of the disclosure. It should be noted that, while the sliding sleeve assemblies 130*a-c* are shown in FIG. 1 as being deployed in an open hole section of the wellbore 106, as indicated above, the principles of the present disclosure are equally applicable to completed or cased sections of the horizontal portion 122 of the wellbore 106. In such embodiments, a cased wellbore 106 may be perforated at predetermined locations in each interval 128*a-c* using any known methods (e.g., explosives, hydra-jetting, etc.) in the art. Such perforations serve to facilitate fluid conductivity between the interior of the work string 114 and the surrounding intervals 128*a-c* of the formation 108.

Each sliding sleeve assembly 130*a-c* may be actuated in order to provide fluid communication between the interior of the work string 114 and the annulus 126 adjacent each corresponding interval 128*a-c* and, therefore, provide fluid communication into and out of the corresponding intervals 128*a-c*. As depicted, each sliding sleeve assembly 130*a-c* may include a sliding sleeve 132 that is axially movable within the work string 114 to expose one or more ports 134 defined in the work string 114. Once exposed, the ports 134 may facilitate fluid communication between the annulus 126 and the interior of the work string 114 such that stimulation and/or production operations may be undertaken in each corresponding interval 128*a-c* of the formation 108.

It is noted that although FIG. 1 depicts the completion assembly 120 as being arranged within the horizontal portion 122 of the wellbore 106, the principles of the systems and methods disclosed herein may be similarly applicable to or otherwise suitable for use in wholly vertical wellbore configurations. Consequently, the horizontal or vertical nature of the wellbore 106 should not be construed as limiting the present disclosure to any particular wellbore 106 configuration. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the heel or surface of the well and the downhole direction being toward the toe or bottom of the well.

To move the sliding sleeve 132 of a given sliding sleeve assembly 130*a-c* to its open position, and thereby expose the corresponding ports 134, a ball release tool 136 may be used introduced into the system 100. A conveyance 138 may be operatively coupled to the ball release tool 136 to convey the ball release tool 136 into the work string 114 and toward the sliding sleeve assemblies 130*a-c*. The conveyance 138 may be any tubular conduit capable of running the ball release tool 136 into the wellbore 116 including, but not limited to, coiled tubing, production tubing, drill string, and the like. As described in more detail below, the ball release tool 136 may include a ball positioned exterior to the ball release tool 136 and sized to mate with a baffle associated with a sliding sleeve of a particular sliding sleeve assembly 130*a-c*. Upon locating the particular sliding sleeve assembly 130*a-c*, fluid pressure within the conveyance 138 may be increased to release the ball to mate with the baffle. Continued hydraulic pressure applied on the ball as seated on the baffle may result in shifting the sliding sleeve between a closed position, where the ports 134 are occluded by the sliding sleeve, and an open position, where the sliding sleeve moves to expose the ports 134 and thereby allow fluid communication between the annulus 126 and the interior of the work string 114.

Figure 2:
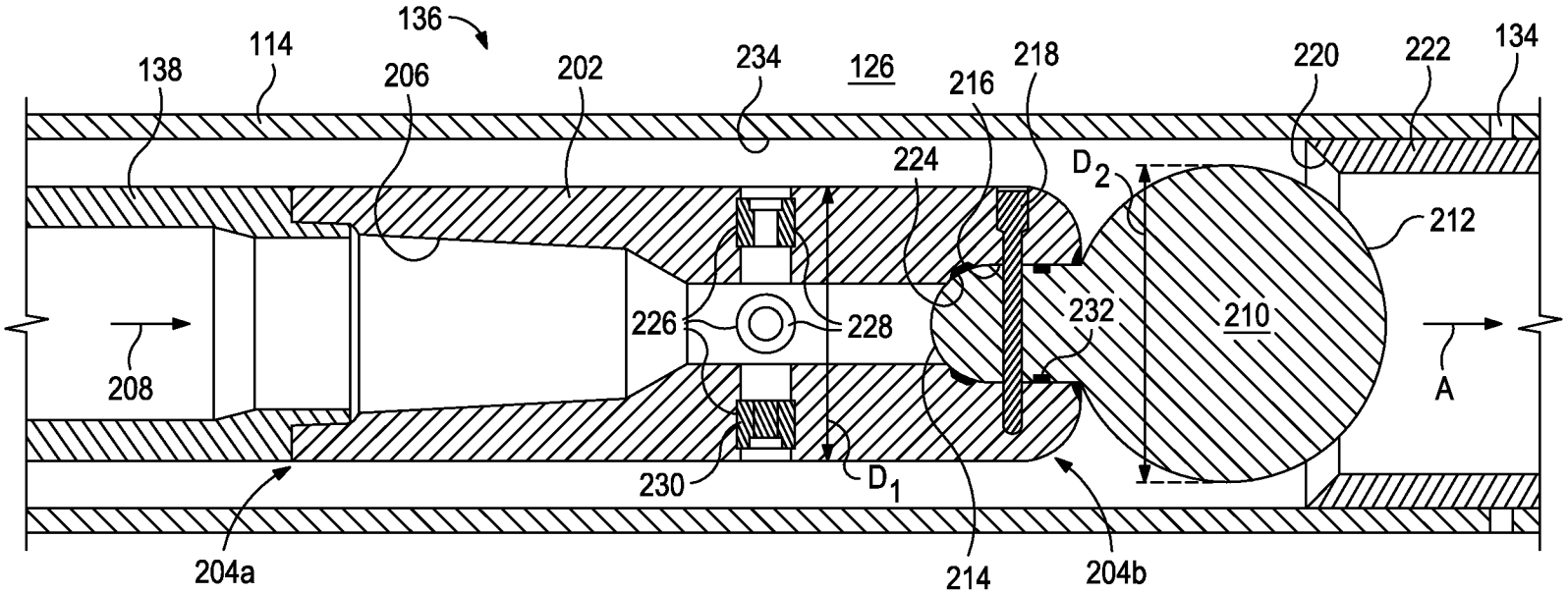
FIG. 2 is a cross-sectional side view showing an exemplary ball release tool.

Referring now to FIG. 2, with continued reference to FIG. 1, illustrated is a cross-sectional side view of the ball release tool 136, according to one or more embodiments. As illustrated, the ball release tool 136 is coupled to the conveyance 138 and positioned within the work string 114, which, as generally described above, may correspond to coiled tubing, drill pipe, drill string, casing, landing string, production tubing, or any combination thereof. The ball release tool 136 may include a generally cylindrical body 202 having a first or uphole end 204*a*, a second or downhole end 204*b*, and defining a flow passageway 206 within the body 202 that extends substantially between the uphole and downhole ends 204*a,b*. The conveyance 138 may be coupled to the body 202 at the uphole end 204*a*, such as via a threaded engagement or using one or more mechanical fasteners (e.g., screws, bolts, pins, snap rings, etc.). Any fluids 208 pumped through the conveyance 138 may be able to fluidly communicate with the ball release tool 136 by flowing into the flow passageway 206.

The ball release tool 136 may further include a ball 210 that defines a bulb 212 and a stem 214 that extends from the bulb 210. The ball 210 may be releasably coupled to the body 202 at the downhole end 204*b*. More particularly, an opening 216 may be defined in the body 202 at the downhole end 204*b* to receive the stem 214, and a shear pin 218 may extend through at least a portion of the body 202 and the stem 214 to at least temporarily secure the stem 214 within the opening 216. As discussed in greater detail below, the shear pin 218 may be configured to shear or otherwise fail upon assuming a predetermined shear load, and thereby release the ball 210 from the body 202.

In the illustrated embodiment, the body 202 may exhibit a first diameter $D_1$ and the bulb 212 of the ball 210 may exhibit a second diameter $D_2$ that is greater than or equal to the first diameter $D_1$. The second diameter $D_2$ may be sized to locate and engage a target baffle 220 provided on or otherwise defined by a sliding sleeve 222 positioned within the work string 114. The sliding sleeve 222 may form part of any one of the sliding sleeve assemblies 130*a-c* of FIG. 1, for example. Moreover, the second diameter $D_2$ may be small enough to allow the ball release tool 136 to traverse or otherwise bypass non-target baffles (not shown) and their associated sliding sleeves (not shown) positioned uphole (i.e., to the left in FIG. 2) from the target baffle 220.

In some embodiments, as illustrated, the shear pin 218 may be a double shear pin that extends entirely through the stem 214 and into opposing portions of the body 202 on opposite angular sides of the opening 216. As a result, the shear pin 218 may require failure at two independent locations to release the ball 210 from the body 202. In other embodiments, however, the shear pin 218 may extend through a portion of the stem 214 and only through one portion of the body 202 (e.g., not into opposing portions of the body 202 on opposite angular sides of the opening 216), without departing from the scope of the disclosure. In yet other embodiments, or in addition thereto, the stem 214 may be releasably coupled to the downhole end 204*b* of the body by being threaded into the opening 216. In such embodiments, the shear pin 218 may be replaced or supplemented with shearable threading between the stem 214 and the inner wall of the opening 216. Similar to the shear pin 218, the shearable threading may be configured to shear or otherwise fail upon assuming the predetermined shear load, and thereby releasing the ball 210 from the body 202.

In some embodiments, the stem 214 may be sized such that it may engage or otherwise be seated on a seat 224 defined within the opening 216 when the ball 210 is releasably coupled to the body 202. As will be appreciated, this may prove advantageous in preventing or mitigating preloading of the shear pin 218 as the ball release tool 136 is run into the work string 114 in the direction A. More particularly, as the ball release tool 136 is conveyed through the work string 114 in the direction A, the ball 210 may occasionally encounter and engage various obstructions (e.g., wellbore debris, non-target baffles, tubing coupling joints, etc.) prior to locating the target baffle 220. Upon engaging such obstructions, an axial load may be transmitted to the ball 210, and having the stem 214 seated on the seat 224 may allow the axial load to be transmitted to the body 202 instead of the shear pin 218. As a result, unintentional failure of the shear pin 118 may be avoided or at least mitigated as the ball release tool 136 is run into the work string 114 and engages various obstructions.

The ball 210 may be made of a variety of materials capable of withstanding downhole conditions. For instance, suitable materials for the ball 210 may include, but are not limited to, a metal (e.g., steel, aluminum, bronze, etc.), a composite material (e.g., a glass-based composite material, fiberglass, carbon fiber, etc.), a dissolvable or degradable material, and any combination thereof. Suitable degradable materials include, but are not limited to, metals that galvanically-react or corrode in wellbore fluid or in a wellbore environment, such as gold, gold-platinum alloys, silver, nickel, nickel-copper alloys, nickel-chromium alloys, copper, copper alloys (e.g., brass, bronze, etc.), chromium, tin, aluminum, iron, zinc, magnesium, and beryllium. Suitable degradable materials may also include degradable plastics, such as polyglycolic acid, polylactic acid, and thiol-based plastics.

Having the ball 210 made of a composite material, such as carbon fiber, may prove advantageous in being able to orient the laminar layers of the composite materials in a predetermined direction. As a result, an operator may be able to at least partially control how the ball 210 lands on the target baffle 222 during operation. More specifically, the mechanical strength of the laminar composite material depends on how the laminar layers are oriented in relation to the stress, strain, and shear forces that the material can withstand. Controlling how the laminar layers are oriented during the manufacturing process and functioning of the ball 210 may help the ball 210 withstand the necessary forces required to carry out its function in the system as a whole.

The ball release tool 136 may further include one or more flow ports 226 (three shown) defined in the body 202. The flow ports 226 may be in fluid communication with the flow passageway 206 such that the fluid 208 pumped through the conveyance 138 and into the flow passageway 206 may be able to exit the body 202 via the flow ports 226. In some embodiments, the flow ports 226 may be equidistantly spaced from each other about the circumference of the body 202. In other embodiments, however, the flow ports 226 may be randomly spaced from each other, without departing from the scope of the disclosure. While a certain number of flow ports 226 are depicted in FIG. 2, it will be appreciated that any number of flow ports 226 (including one) may be employed in the body 202.

In some embodiments, a nozzle 228 (two shown) may be positioned within one or more of the flow ports 226. The nozzles 228 may be configured to meter or regulate the amount of fluid 208 exiting the body 202 at the corresponding flow ports 226. Moreover, in some embodiments, a plug 230 (one shown) may be positioned in one or more of the flow ports 226. The plugs 230 may be configured to prevent the fluid 208 from exiting the body 202 at the corresponding flow ports 226.

Exemplary operation of the ball release tool 136 is now provided. The ball release tool 136 may be introduced into the work string 114 as coupled to the conveyance 138. The conveyance 138 may be configured to push or propel the ball release tool 136 in the downhole direction A and toward the target baffle 220. As the ball release tool 136 is run into the work string 114, fluid 208 (e.g., a clean fluid) may be pumped through the ball release tool 136. More particularly, the fluid 208 may be pumped into the conveyance 138 and flowed to the flow passageway 206. The fluid 208 may then be diverted out of the body 202 via the flow ports 226. In some embodiments, one of more of the flow ports 226 may have a nozzle 228 secured therein to regulate the flow rate of the fluid 208 out of the body 202. In other embodiments, one of more of the flow ports 226 may have a plug 230 secured therein to prevent the fluid 208 from exiting the body 202 at that particular flow port 226, and thereby regulate the overall flow rate out of the body 202. In yet other embodiments, all of the flow ports 226 may remain unobstructed or, alternatively, all of the flow ports 226 may have a nozzle 228 or a plug 230 secured therein for operation.

The fluid 208 entering the flow passageway 206 may also impinge on the ball 210 and, more particularly, the stem 214 as secured within the opening 216 with the shear pin 218. In some embodiments, a seal 232 (e.g., an O-ring or the like) may be positioned at the interface between the stem 214 and the opening 216 and may be configured to prevent the fluid 208 from migrating past the location of the seal 232 during run-in. While depicted as positioned downhole (i.e., to the right of) from the shear pin 218, it will be appreciated that the seal 232 may alternatively be positioned uphole from the shear pin 218, without departing from the scope of the disclosure.

The combination of preventing the fluid 208 from migrating past the stem 214 at the location of the seal 232 and regulating the flow out of the flow ports 226 with the nozzles 228 and/or the plugs 230 may generate a backpressure within the conveyance 138. The backpressure may create a pressure differential across the stem 214, which may place an axial load on the ball 210 in the downhole direction A. The magnitude of the axial load on the ball 210 may be manipulated and otherwise optimized by using more or less plugs 230, changing the number or size of the nozzles 228 in the flow ports 226, and changing the flow rate of the fluid 208 into the body 202. As the ball release tool 136 is being conveyed to the target baffle 220, the fluid 208 may be pumped to the ball release tool 136 at a first flow rate, which may be defined as any fluid flow rate that transmits an axial load to the stem 214 that is lower than the predetermined shear limit of the shear pin 218. As a result, pumping the fluid 208 into the flow passageway 206 at the first flow rate may maintain the shear pin 218 intact such that the shear pin 218 does not prematurely fail.

The ball release tool 136 may be conveyed or moved within the work string 114 until locating the target baffle 220 and the associated sliding sleeve 222. In some embodiments, this may be accomplished by "tagging" the target baffle 220 with the ball 210, which can be sensed at the surface 104 (FIG. 1). In other embodiments, however, this may be accomplished using downhole sensors, through wellbore mapping, and/or using depth correlation techniques that allow an operator to know the exact location of the ball release tool 136 within the work string 114. Once the target baffle 220 has been properly located, the flow rate of the fluid 208 may be increased within the conveyance 138 to shear the shear pin 218 and release the ball 210. More particularly, the flow rate of the fluid 208 may be increased to a second flow rate that is greater than the first flow rate, and thereby generate a backpressure sufficient to overcome the predetermined shear limit of the shear pin 218. Upon assuming the axial load applied by the second flow rate, the shear pin 218 may fail and thereby release the ball 210 from the body 202, and the ball 202 may then be free to seat on the target baffle 220, which may be sized to receive the bulb 212.

With the ball 210 engaged on the target baffle 220, the fluid pressure within the work string 114 may be increased to apply an axial load on the ball 210 and the target baffle 220, and thereby shift the sliding sleeve 222 from a closed position to an open position. In some embodiments, the fluid pressure increase to move the sliding sleeve 222 may originate from the conveyance 138, but may alternatively (or in addition thereto) originate through the work string 114. FIG. 2 depicts the sliding sleeve 222 in the closed position, where one or more ports 134 defined in the work string 114 are occluded by the sliding sleeve 222. Shifting the sliding sleeve 222 downhole to the open position may expose the ports 134 and thereby allow fluid communication between the annulus 126 and an interior 234 of the work string 114.

Once the sliding sleeve 222 is moved to the open position, the ball release tool 136 (sans the ball 210) may be retrieved to the surface 104 (FIG. 1) and one or more wellbore operations may then be undertaken within the well. In some embodiments, for instance, high pressure fluid may be injected into the annulus 126 and the surrounding subterranean formation via the ports 134 to hydraulically fracture the formation. In other embodiments, fluids from the surrounding subterranean formation may be drawn into the work string 114 and to the surface 104 via the ports 134, such as in a production operation.

While the target baffle 220 is described and depicted herein as being associated with the sliding sleeve 222 of a sliding sleeve assembly 130*a-c* (FIG. 1), it should be noted that the target baffle 220 may alternatively comprise or otherwise be associated with any downhole tool or structure, in keeping with the scope of the disclosure. For instance, the target baffle 220 may be a type of landing baffle used to shut off fluid communication below the landing baffle once the ball 210 successfully lands thereon. In such embodiments, the combination of the ball 210 and the target baffle 220 may be used to pressurize the work string 114 above the target baffle 220. Those skilled in the art will readily recognize other downhole tools and/or structures that the target baffle 220 may be associated with, without departing from the scope of the disclosure.

Embodiments disclosed herein include:

A. A ball release tool that includes a body providing a first end and a second end, and defining a flow passageway extending between the first and second ends, a ball releasably coupled to the body at the second end, and one or more flow ports defined in the body and in fluid communication with the flow passageway, wherein pressure of a fluid introduced into the flow passageway is increased to release the ball from the body.

B. A well system that includes a work string extendable into a wellbore and having a target baffle positioned within the work string, and a ball release tool extendable into the work string on a conveyance, the ball release tool including a body that provides a first end, a second end, and a flow passageway that extends between the first and second ends, wherein the conveyance is coupled to the first end and the flow passageway is in fluid communication with the conveyance, a ball releasably coupled to the body at the second end, and one or more flow ports defined in the body and in fluid communication with the flow passageway and the conveyance, wherein increasing a pressure of a fluid introduced into the flow passageway via the conveyance releases the ball from the body, and wherein the ball is sized to engage the target baffle upon being released from the body C. A method that includes introducing a ball release tool into a work string arranged within a wellbore, the ball release tool being coupled to a conveyance and including a body that provides a first end, a second end, and a flow passageway that extends between the first and second ends, wherein the conveyance is coupled to the first end and the flow passageway is in fluid communication with the conveyance, a ball releasably coupled to the body at the second end, and one or more flow ports defined in the body and in fluid communication with the flow passageway and the conveyance, pumping a fluid through the conveyance and to the ball release tool and thereby generating a backpressure within the body and the conveyance, locating the ball release tool at a target baffle positioned within the work string, increasing a pressure of the fluid to increase the backpressure and thereby release the ball from the body, and landing the ball on the target baffle.

Each of embodiments A, B, and C may have one or more of the following additional elements in any combination: Element 1: wherein the ball defines a bulb and a stem that extends from the bulb, and wherein the body further defines an opening at the second end to receive the stem. Element 2: wherein the ball is releasably coupled to the body with a shear pin that extends through at least a portion of the body and the stem. Element 3: wherein the stem is threaded into the opening and the ball is releasably coupled to the body with shearable threading between the stem and the opening. Element 4: wherein the stem engages a seat defined within the opening when the ball is releasably coupled to the body at the second end. Element 5: wherein the body exhibits a first diameter and the bulb exhibits a second diameter that is greater than or equal to the first diameter. Element 6: wherein the ball is made of a material selected from the group consisting of a metal, a composite material, a degradable material, and any combination thereof. Element 7: further comprising a nozzle positioned within at least one of the one or more flow ports. Element 8: further comprising a plug positioned within at least one of the one or more flow ports. Element 9: wherein the one or more flow ports are unobstructed.

Element 10: wherein the conveyance is at least one of coiled tubing, drill pipe, drill string, casing, landing string, production tubing, and any combination thereof. Element 11: wherein the ball defines a bulb and a stem that extends from the bulb, and wherein the body further defines an opening at the second end to receive the stem. Element 12: wherein the ball is releasably coupled to the body with a shear pin that extends through at least a portion of the body and the stem. Element 13: wherein the stem engages a seat defined within the opening when the ball is releasably coupled to the body at the second end. Element 14: wherein the body exhibits a first diameter and the bulb exhibits a second diameter that is greater than or equal to the first diameter. Element 15: further comprising a nozzle positioned within at least one of the one or more flow ports. Element 16: further comprising a plug positioned within at least one of the one or more flow ports.

Element 17: further comprising regulating a flow of the fluid out of the body with at least one of a nozzle and a plug positioned within at least one of the one or more flow ports. Element 18: wherein the ball defines a bulb and a stem that extends from the bulb, and the body further defines an opening at the second end to receive the stem, the method further comprising releasably coupling the ball to the body with a shear pin that extends through at least a portion of the body and the stem. Element 19: wherein increasing the pressure of the fluid to increase the backpressure and thereby release the ball from the body comprises increasing a flow rate of the fluid to overcome a predetermined shear limit of the shear pin. Element 20: wherein the stem engages a seat defined within the opening when the ball is releasably coupled to the body, the method further comprising assuming axial loads on the bulb as the ball engages obstructions within the work string, and transmitting the axial loads to the body at the seat via the stem. Element 21: wherein the target baffle is defined on a sliding sleeve, the method further comprising increasing the pressure of the fluid within the work string, and moving the sliding sleeve from a closed position to an open position. Element 22: wherein the target baffle is a landing baffle, the method further comprising increasing the pressure of the fluid within the work string after the ball lands on the target baffle.

By way of non-limiting example, exemplary combinations applicable to A, B, and C include: Element 1 with Element 2; Element 1 with Element 3; Element 1 with Element 4; Element 11 with Element 12; Element 11 with Element 13; Element 18 with Element 19; and Element 19 with Element 20.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A ball release tool, comprising:

a body providing an uphole end and a downhole end, the body defining a flow passageway extending between the uphole and downhole ends;

a ball releasably coupled to the body at the downhole end and releasably sealing the flow passageway at the downhole end, wherein the ball further comprises a bulb and a stem that extends from the bulb, and wherein the body further defines an opening at the second end to receive the stem; and one or more flow ports defined in the body and in fluid communication with the flow passageway, wherein increasing pressure of a fluid introduced into the flow passageway past a predetermined threshold releases the ball from the downhole end.

2. The ball release tool of claim 1, wherein the ball is releasably coupled to the body with a shear pin that extends through at least a portion of the body and the stem.

3. The ball release tool of claim 1, wherein the stem is threaded into the opening and the ball is releasably coupled to the body with shearable threading between the stem and the opening.

4. The ball release tool of claim 1, wherein the stem engages a seat defined within the opening when the ball is releasably coupled to the body at the downhole end.

5. The ball release tool of claim 2, wherein the body exhibits a first diameter and the bulb exhibits a second diameter that is greater than or equal to the first diameter.

6. The ball release tool of claim 1, wherein the ball is made of a material selected from the group consisting of a metal, a composite material, a degradable material, and any combination thereof.

7. The ball release tool of claim 1, further comprising a nozzle positioned within at least one of the one or more flow ports.

8. The ball release tool of claim 1, further comprising a plug positioned within at least one of the one or more flow ports.

9. The ball release tool of claim 1, wherein the one or more flow ports are unobstructed.

10. A well system, comprising:

a work string extendable into a wellbore and having a target baffle positioned within the work string; and a ball release tool extendable into the work string on a conveyance, the ball release tool including:

a body that provides an uphole end, a downhole end, and a flow passageway that extends between the uphole and downhole ends, wherein the conveyance is coupled to the uphole end and the flow passageway is in fluid communication with the conveyance;

a ball releasably coupled to the body at the downhole end and releasably sealing the flow passageway at the downhole end wherein the ball defines a bulb and a stem that extends from the bulb, and wherein the body further defines an opening at the second end to receive the stem; and one or more flow ports defined in the body and in fluid communication with the flow passageway and the conveyance, wherein increasing a pressure of a fluid introduced into the flow passageway via the conveyance releases the ball from the body, and wherein the ball is sized to engage the target baffle upon being released from the downhole end.

11. The well system of claim 10, wherein the conveyance is at least one of coiled tubing, drill pipe, drill string, casing, landing string, production tubing, and any combination thereof.

12. The well system of claim 10, wherein the ball is releasably coupled to the body with a shear pin that extends through at least a portion of the body and the stem.

13. The well system of claim 10, wherein the stem engages a seat defined within the opening when the ball is releasably coupled to the body at the downhole end.

14. The well system of claim 10, wherein the body exhibits a first diameter and the bulb exhibits a second diameter that is greater than or equal to the first diameter.

15. The well system of claim 10, further comprising a nozzle positioned within at least one of the one or more flow ports.

16. The well system of claim 10, further comprising a plug positioned within at least one of the one or more flow ports.

17. A method, comprising:

introducing a ball release tool into a work string arranged within a wellbore, the ball release tool being coupled to a conveyance and including:

a body that provides an uphole end, a downhole end, and a flow passageway that extends between the uphole and downhole ends, wherein the conveyance is coupled to the uphole end and the flow passageway is in fluid communication with the conveyance;

a ball releasably coupled to the body at the downhole end wherein the ball defines a bulb and a stem that extends from the bulb, and the body further defines an opening at the second end to receive the stem; and one or more flow ports defined in the body and in fluid communication with the flow passageway and the conveyance;

releasably sealing the flow passageway at the downhole end via the ball;

pumping a fluid through the conveyance and to the ball release tool and thereby generating a backpressure within the body and the conveyance;

locating the ball release tool at a target baffle positioned within the work string;

increasing a pressure of the fluid to increase the backpressure and thereby release the ball from the downhole end; and landing the ball on the target baffle.

18. The method of claim 17, further comprising regulating a flow of the fluid out of the body with at least one of a nozzle and a plug positioned within at least one of the one or more flow ports.

19. The method of claim 17, further comprising releasably coupling the ball to the body with a shear pin that extends through at least a portion of the body and the stem.

20. The method of claim 19, wherein increasing the pressure of the fluid to increase the backpressure and thereby release the ball from the body comprises increasing a flow rate of the fluid to overcome a predetermined shear limit of the shear pin.

21. The method of claim 20, wherein the stem engages a seat defined within the opening when the ball is releasably coupled to the body, the method further comprising:

assuming axial loads on the bulb as the ball engages obstructions within the work string; and transmitting the axial loads to the body at the seat via the stem.

22. The method of claim 17, wherein the target baffle is defined on a sliding sleeve, the method further comprising:

increasing the pressure of the fluid within the work string; and moving the sliding sleeve from a closed position to an open position.

23. The method of claim 17, wherein the target baffle is a landing baffle, the method further comprising increasing the pressure of the fluid within the work string after the ball lands on the target baffle.

* * * * *